US008897465B2

(12) United States Patent
Muza

(10) Patent No.: US 8,897,465 B2
(45) Date of Patent: Nov. 25, 2014

(54) CLASS D MICRO-SPEAKER

(75) Inventor: John M. Muza, Venetia, PA (US)

(73) Assignee: Robert Bosch GmbH, Stuttgart (DE)

( * ) Notice: Subject to any disclaimer, the term of this patent is extended or adjusted under 35 U.S.C. 154(b) by 485 days.

(21) Appl. No.: 13/150,287

(22) Filed: Jun. 1, 2011

(65) Prior Publication Data

US 2012/0308046 A1 Dec. 6, 2012

(51) Int. Cl.
*H04R 3/00* (2006.01)
*H04R 25/00* (2006.01)
*H04R 19/02* (2006.01)

(52) U.S. Cl.
CPC . *H04R 19/02* (2013.01); *H04R 3/00* (2013.01)
USPC ..... 381/116; 381/117; 381/150

(58) Field of Classification Search
USPC ..... 381/59, 63, 97, 86, 71.1, 191, 120, 164, 381/116, 117, 150, 111, 186, 332, 396
See application file for complete search history.

(56) References Cited

U.S. PATENT DOCUMENTS

| | | | | |
|---|---|---|---|---|
| 4,360,707 | A | 11/1982 | Joseph et al. | |
| 5,347,587 | A | 9/1994 | Takahashi et al. | |
| 5,729,605 | A * | 3/1998 | Bobisuthi et al. | 379/430 |
| 6,373,955 | B1 | 4/2002 | Hooley | |
| 7,456,685 | B2 * | 11/2008 | Chen | 330/10 |
| 7,472,048 | B2 | 12/2008 | Puckette | |
| 2005/0147265 | A1 * | 7/2005 | Smits et al. | 381/191 |
| 2006/0125554 | A1 * | 6/2006 | Chen et al. | 330/10 |
| 2009/0022340 | A1 | 1/2009 | Krichtafovitch et al. | |
| 2009/0154730 | A1 * | 6/2009 | Demuynck | 381/116 |
| 2009/0245547 | A1 * | 10/2009 | Lee et al. | 381/191 |
| 2010/0002900 | A1 | 1/2010 | Cohen et al. | |
| 2010/0027813 | A1 * | 2/2010 | Wu | 381/120 |
| 2012/0148074 | A1 * | 6/2012 | Bastiaens et al. | 381/191 |

FOREIGN PATENT DOCUMENTS

| | | |
|---|---|---|
| EP | 0597687 | 5/1994 |
| WO | 2009066290 | 5/2009 |

OTHER PUBLICATIONS

Hanseup Kim, Bi-directional Electrostatic Microspeaker with Two Large-Deflection Flexible Membranes Actuated by Single/Dual Electrodes, p. 89-92.*

* cited by examiner

*Primary Examiner* — Vivian Chin
*Assistant Examiner* — William A Jerez Lora
(74) *Attorney, Agent, or Firm* — Michael Best & Friedrich LLP

(57) ABSTRACT

A micro-speaker. The micro-speaker includes a first plate, a second plate, and a diaphragm. The first plate is biased to a first voltage. The second plate is biased to a second voltage. The diaphragm is positioned between the first plate and the second plate and is configured to receive a digital signal. The digital signal causes the diaphragm to cycle between fully displaced toward the first plate and fully displaced toward the second plate, creating air pressure pulses that mimic the digital signal.

18 Claims, 3 Drawing Sheets

CLASS D MICRO-SPEAKER

BACKGROUND

The invention relates to an electrostatic speaker, specifically a class D electro-static micro-speaker.

Speakers produce sound waves by converting electrical signals into air pressure pulses. A classic dynamic loudspeaker uses a voice coil in a magnetic gap to move a cone and convert the electrical signals into air pressure pulses. A prior-art electrostatic speaker 100, such as shown in FIG. 1, has a diaphragm 105 biased (by springs 110) at a midpoint within a usable gap 115. An analog electric signal 120 (i.e., an audio signal) is applied to the diaphragm 105 which cyclically draws the diaphragm 105 toward from a back-plate 125 and allows the diaphragm 105 to return to a resting position (by the biasing force of the springs 110).

In the prior-art electrostatic speaker 100, the springs 110, along with air that is moved (e.g., in the usable gap 115), tend to dampen the response of the electrostatic speaker 100. The electrostatic speaker 100 also has numerous nonlinear mechanisms (e.g., mechanical stiffness which varies based on the position of the diaphragm 105) which affect the performance of the speaker 100. In addition, the diaphragm is limited to only about 10% of its actual range to reduce linearity issues and to guard against "snap-in" (i.e., where the diaphragm latches in a fully extended position). Micro-speakers are a sub-set of electrostatic speakers, referring generally to the size of the electrostatic speaker. Micro-speakers are small speakers such as those found in cell phones.

Class D amplifiers combine a desired output signal with a relatively high-frequency signal to generate a digital signal which can be amplified by switching power devices. The frequency of the high-frequency signal is typically chosen to be ten or more times the highest frequency of interest in the desired output signal. The digital signal includes both a low-frequency component (i.e., the desired output signal) and a high-frequency component. A passive low-pass filter is used to remove the high-frequency component, and recover the desired low-frequency output signal.

SUMMARY

The class D micro-speaker of the invention provides flatter frequency response throughout the audio band, improved linearity and distortion performance, and greater sound pressure levels than the prior art electrostatic speakers 100. The class D micro-speaker of the invention overcomes these issues by having only two states for a diaphragm—snapped up or snapped down (i.e., displaced 100% of its range). To achieve these states, the electrical input of the class D micro-speaker overdrives the core mechanical resonances to drive the diaphragm to geometrical stops, independent of the signal level. Because the class D micro-speaker travels to its full snapped up or snapped down position, it is using 100% of its range (compared to the prior art speaker's 10% range). This generates a much greater sound pressure level (SPL) output for an equivalently sized speaker, reducing the cost and size of the speaker.

In one embodiment, the invention provides a micro-speaker. The micro-speaker includes a first plate, a second plate, and a diaphragm. The first plate is biased to a first voltage. The second plate is biased to a second voltage. The diaphragm is positioned between the first plate and the second plate and is configured to receive a digital signal. The digital signal causes the diaphragm to cycle between a first fully displaced position near the first plate and a second fully displaced position near the second plate, creating air pressure pulses that mimic the digital signal.

In another embodiment the invention provides a method of producing sound waves. The method includes receiving an analog electric signal representative of the sound waves to be produced, generating a high-frequency signal, producing a pulse-width-modulated signal based on the analog electric signal and the high-frequency signal, amplifying the pulse-width-modulated signal, and applying the amplified pulse-width-modulated signal to a diaphragm of a speaker. The diaphragm is positioned between a first plate and a second plate. The first plate has a first electrical bias, and the second plate has a second electrical bias. The amplified pulse-width-modulated signal causes the diaphragm to cycle between a fully displaced position toward the first plate and a second fully displaced position toward the second plate, creating air pressure pulses that mimic the pulse-width-modulated signal.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
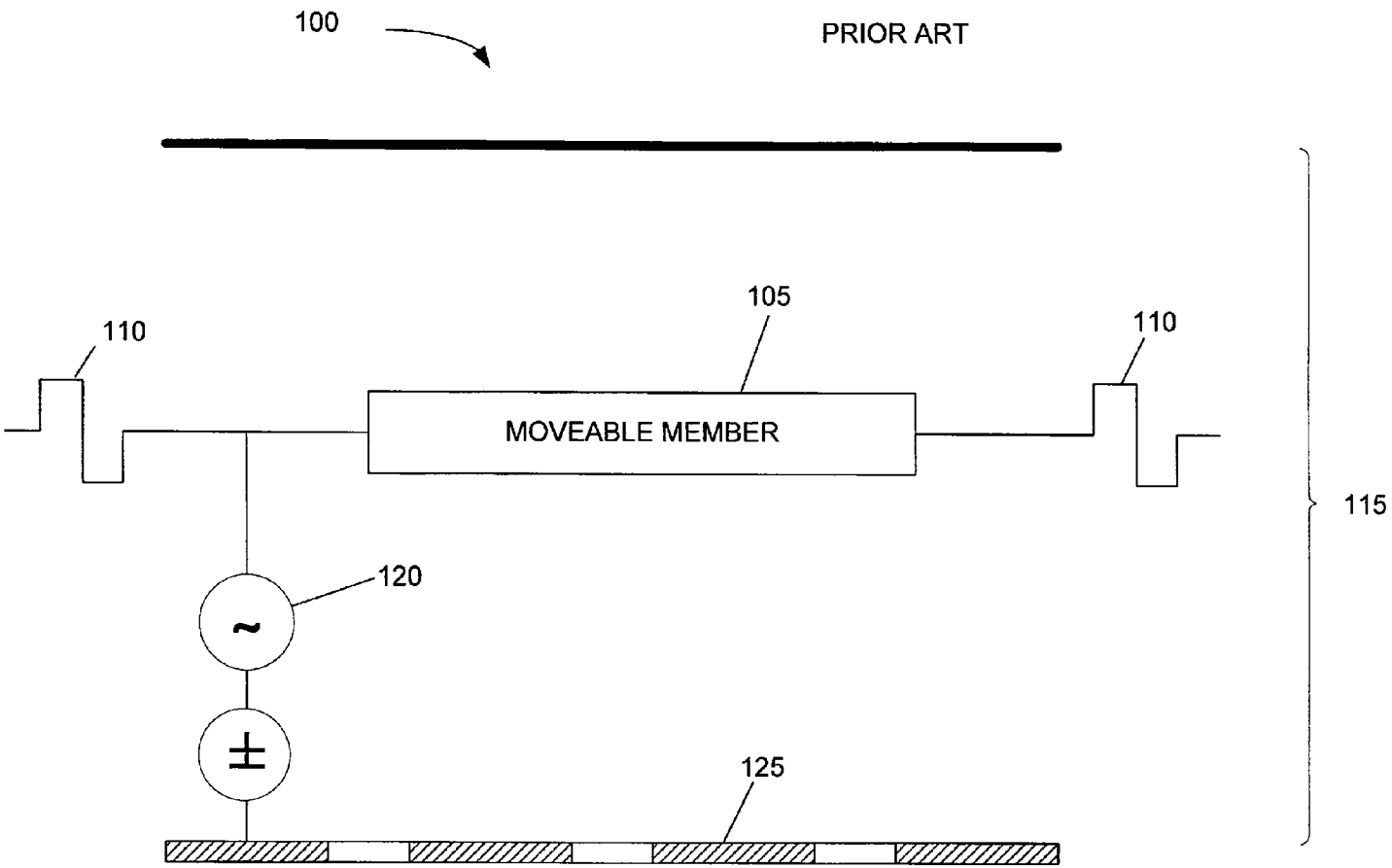
FIG. 1 is a diagram of a prior-art electrostatic speaker.
Figure 2:
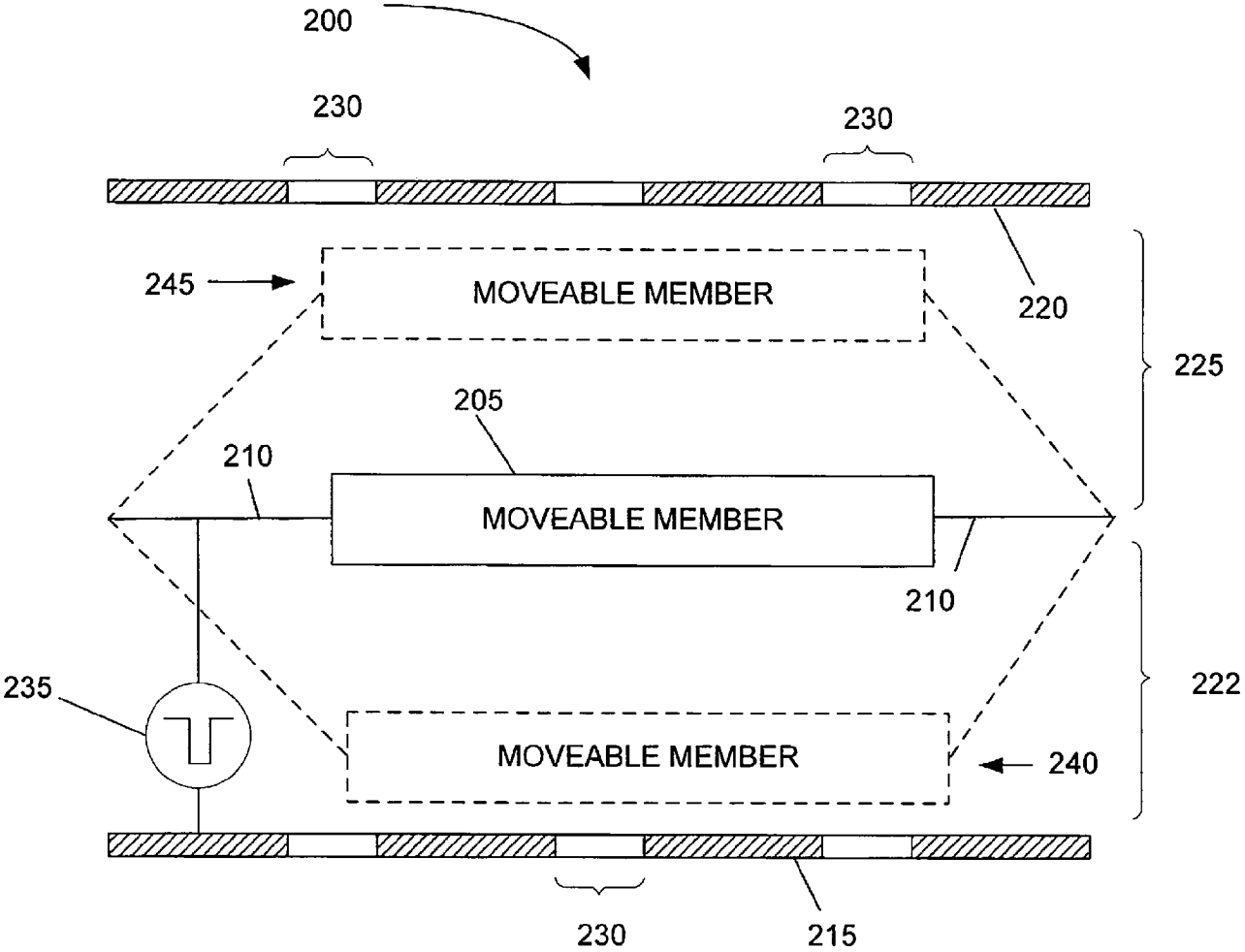
FIG. 2 is a diagram of a class D micro-speaker.

FIG. 2 shows a construction of a class D micro-speaker 200. The speaker 200 includes a diaphragm 205, made of an electrically conductive material, supported by a polysilicon 210. One or more structures (e.g., a housing, a MEMS structure, etc.) supports the elements of the speaker 200 including the polysilicon 210. The diaphragm 205 is positioned approximately midway between a back-plate 215 and a top-plate 220, with an air gap 225 between the diaphragm 205 and each plate 215 and 220. In some constructions, the diaphragm 205 is positioned closer to one of the back-plate 215 or the top-plate 220. Both the back-plate 215 and the top-plate 220 include openings 230 to allow air in the air gaps 225 to escape/enter the speaker 200 when the diaphragm 205 is moved toward the top-plate 220 or toward the back-plate 215. The back-plate 215 is held at a ground potential, while the top-plate 220 is held at a relatively high voltage level (compared to CMOS voltage levels, e.g., 10 to 50 volts DC). The voltage level required for the top-plate 220 is dictated by a number of design characteristics (e.g., desired SPL, costs, etc.) and the size of the air gap 225. The larger the gap 225, the higher the voltage needed to snap the diaphragm 205 toward and away from the top-plate 225.

In operation, the diaphragm 205 receives a signal 235 (i.e., a digital signal) that cycles the diaphragm 205 between a positive voltage and ground. When the signal 235 applied to the diaphragm 205 is a positive voltage, the diaphragm 205 is drawn toward the back-plate 215, causing the diaphragm 205 to snap into a fully displaced position 240 toward or near the back-plate 215. Snapping the diaphragm 205 into this position 240 forces air out of the air gap 222 through the openings 230 in the back-plate 215, and draws air into the air gap 225 through the openings 230 in the top-plate 220. The fully displaced position 240 depends on the play in the polysilicon 210, but does not extend to contact the back-plate 215. Similarly, when the diaphragm 205 receives a ground potential from signal 235, it is drawn toward the top-plate 220, snapping into a fully displaced position 245 toward or near the top-plate 220. Snapping the diaphragm 205 into this position 245 forces air out of the air gap 225 through the openings 230 in the top-plate 220, and draws air into the air gap 222 through the openings 230 in the back-plate 215. Forcing the air out of the air gaps 220 and 225 generates air pressure pulses (e.g., a sound wave). In some embodiments, physical stops are used to limit the travel of the diaphragm 205 toward the top-plate 220 and the back-plate 215.

Figure 3:
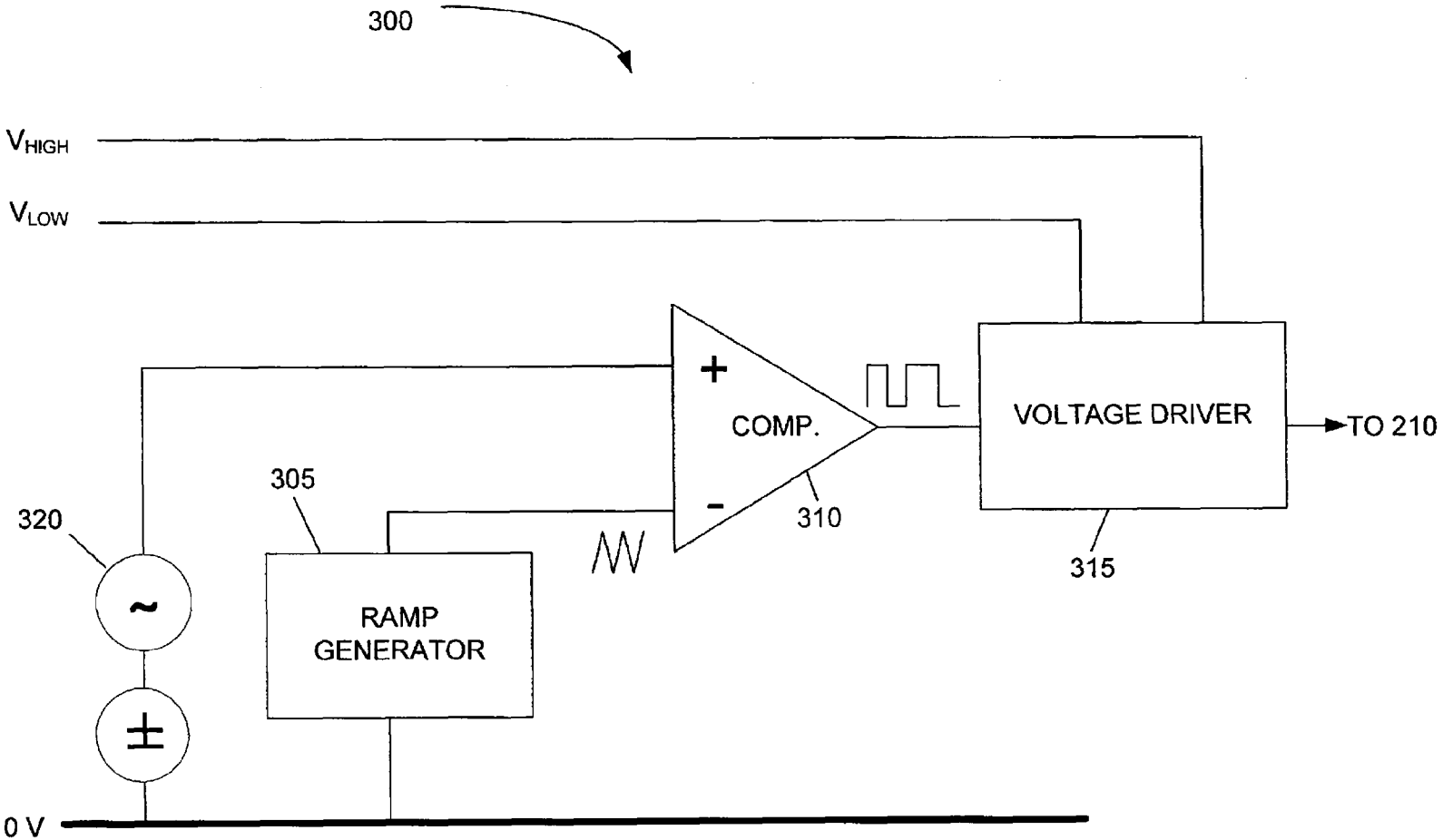
FIG. 3 is a schematic/block diagram of a circuit for driving the micro-speaker of FIG. 2.

FIG. 3 shows a block diagram of a circuit 300 for providing the digital signal 235 to the diaphragm 205 of the class D micro-speaker 200. The circuit 300 includes a ramp generator 305, a comparator 310, and a voltage driver 315. The ramp generator 305 produces a triangle wave having a high-frequency relative to the human audible range (i.e., the high-frequency signal). Because the human audible range is between about 20 Hz and 20 kHz, the frequency of the triangle wave is preferably 200 kHz or more. The triangle wave is input into the comparator 310. The comparator 310 also receives an analog electric signal 320 (i.e., the audio signal) to be converted to a sound wave (i.e., the output of the speaker 200). The output of the comparator 310 is a pulse-width-modulated signal (e.g., a class D signal). The class D pulse-width-modulated signal is a digital signal that incorporates the sound information from the electric signal (i.e., a low-frequency component) and the high-frequency of the triangle wave (i.e., a high-frequency component). The class D pulse-width-modulated signal is provided to the voltage driver 315. The voltage driver 315 amplifies the class D pulse-width-modulated signal to a voltage level sufficient to fully displace the diaphragm 205. The diaphragm 205 cycles between being fully displaced toward the top-plate 220 and fully displaced toward the back-plate 215, based on the class D pulse-width-modulated signal. The diaphragm 205 is thus able to displace a relatively large amount of air, producing a sound wave having an SPL much greater than an equivalently sized prior art electrostatic speaker 100.

The sound wave (i.e., the air pressure pulses) produced by the diaphragm 205 mimics the digital signal 235, and contains both the audio component and the high-frequency component. In some embodiments, the high-frequency component of the sound wave is filtered by a construction of a housing of the speaker 205. In other embodiments, the human ear is relied upon to filter out the high-frequency components of the sound wave.

In some constructions, the frequency of the triangle wave is used to control the volume of the speaker 200. The higher the frequency, the more times the diaphragm 205 will cycle between being displaced toward the top-plate 220 and the back-plate 215 during positive cycles of the audio signal. Because the diaphragm 205 moves the same volume of air each time it cycles, the higher frequency will move a larger volume of air increasing the SPL (i.e., the volume of the speaker 200).

The class D micro-speaker of the invention is especially well suited for small speaker applications such as ear buds and cell phones.

Various features and advantages of the invention are set forth in the following claims.

What is claimed is:

1. A micro-speaker comprising:

a first plate including a plurality of openings and biased to a first voltage;

a second plate including a plurality of openings and biased to a second voltage; and a diaphragm positioned between the first plate and the second plate and configured to receive a digital signal, the digital signal causing the diaphragm to cycle between a first fully displaced position near the first plate and a second fully displaced position near the second plate, forcing air through the plurality of openings in the first plate and the second plate, and creating air pressure pulses that mimic the digital signal; and wherein the digital signal creates a sufficient bias such that the diaphragm is fully displaced immediately and does not stop at any point between the first fully displaced position and the second fully displaced position, the first fully displaced position being a first distance from the first plate such that the diaphragm does not contact the first plate, and the second fully displaced position being a second distance from the second plate such that the diaphragm does not contact the second plate.

2. The speaker of claim 1, wherein the digital signal is a class D pulse-width-modulated signal having a low-frequency audio component and a high-frequency component.

3. The speaker of claim 2, wherein the high-frequency component has a frequency of 200 kHz or more.

4. The speaker of claim 1, wherein a high-frequency component of the air pressure pulses is filtered out by a housing of the speaker.

5. The speaker of claim 2, wherein a high-frequency component of the air pressure pulses is filtered out by a human ear.

6. The speaker of claim 1, wherein the first voltage is about five volts DC and the second voltage is about zero volts DC.

7. The speaker of claim 6, wherein the digital signal alternates between zero volts DC and a positive DC voltage significantly greater than five volts DC.

8. The speaker of claim 1, wherein the diaphragm is positioned approximately midway between the first and second plates.

9. The speaker of claim 1, further comprising stops to limit the displacement of the diaphragm.

10. The speaker of claim 1, further comprising a ramp generator configured to produce a triangle wave signal, a comparator configured to receive the triangle wave signal and an analog audio signal and to output a pulse-width-modulated digital signal, and a voltage driver configured to receive the pulse-width-modulated digital signal and to amplify the pulse-width-modulated digital signal, the amplified pulse-width-modulated digital signal being the digital signal.

11. A method of producing sound waves, the method comprising:

receiving an analog electric signal representative of the sound waves to be produced;

generating a high-frequency signal;

producing a pulse-width-modulated signal based on the analog electric signal and the high-frequency signal;

amplifying the pulse-width-modulated signal;

applying the amplified pulse-width-modulated signal to a diaphragm of a speaker, the diaphragm positioned between a first plate and a second plate, the first plate having a first electrical bias and the second plate having a second electrical bias, the amplified pulse-width-modulated signal causing the diaphragm to cycle between a fully displaced position toward the first plate and a second fully displaced position toward the second plate, creating air pressure pulses that are forced through openings in the first and second plates and mimic the pulse-width-modulated signal; and wherein the pulse-width-modulated signal creates a sufficient bias such that the diaphragm is fully displaced immediately and does not stop at any point between the first fully displaced position and the second fully displaced position, the first fully displaced position being a first distance from the first plate such that the diaphragm does not contact the first plate, and the second fully displaced position being a second distance from the second plate such that the diaphragm does not contact the second plate.

12. The method of claim 11, wherein the pulse-width-modulated signal is a class D signal.

13. The method of claim 11, wherein the high-frequency signal has a frequency greater than 200 kHz.

14. The method of claim 11, further comprising filtering out a high-frequency component of the air pressure pulses by a housing of the speaker.

15. The method of claim 11, wherein a high-frequency component of the air pressure pulses is filtered out by a human ear.

16. The method of claim 11, wherein the first electrical bias is about five volts DC and the second electrical bias is about zero volts DC.

17. The method of claim 16, wherein the pulse-width-modulated signal cycles between zero volts DC and a positive DC voltage greater than ten volts DC.

18. The method of claim 11, wherein the high-frequency signal is a triangle wave signal produced by a ramp generator, a comparator receives the triangle wave signal and the analog electric signal and outputs a first pulse-width-modulated signal, and a voltage driver receives the first pulse-width-modulated signal and amplifies the first pulse-width-modulated signal to produce the pulse-width-modulated signal.

* * * * *